United States Patent [19]

Hunter

[11] 4,363,357

[45] Dec. 14, 1982

[54] ROTARY DRILLING HEAD

[76] Inventor: Joseph M. Hunter, 25 Mobile Manor, Getty Ave., Indiana, Pa. 15701

[21] Appl. No.: 195,633

[22] Filed: Oct. 9, 1980

[51] Int. Cl.[3] ..... E21B 33/03

[52] U.S. Cl. ..... 166/84; 175/209; 277/31; 285/55

[58] Field of Search ..... 175/195, 214, 209, 210; 166/84, 82; 277/31, 2; 251/1 R, 1 B; 285/16, 55

[56] References Cited

U.S. PATENT DOCUMENTS

| | | | |
|---|---|---|---|
| 3,128,614 | 4/1964 | Auer | 166/84 X |
| 3,400,938 | 9/1968 | Williams | 277/31 |
| 3,497,244 | 2/1970 | Grantom | 285/16 |

*Primary Examiner*—Ernest R. Purser
*Attorney, Agent, or Firm*—Harvey B. Jacobson

[57] ABSTRACT

A rotary drilling head for a rotary drilling apparatus including a hollow or tubular base including a discharge outlet and a lower end adapted to be mounted on a well casing, or the like, and a housing with a rotatable spindle therein insertable into the base in a sealed relationship with the spindle including a stripper rubber at the lower end thereof, and a non-metallic driving connection with the Kelly bar at the upper end and journaled internally of the housing through thrust bearing assemblies and sealed in relation thereto by a plurality of unique seal arrangements. Pressurized lubrication is communicated with a passageway defined between the housing and rotatable spindle to provide continuous pressurized lubrication by an air-oil mist. The housing is removably secured to the base by a split clamp structure to facilitate assembly and disassembly of the housing and spindle components with respect to the base.

14 Claims, 5 Drawing Figures

ROTARY DRILLING HEAD

BACKGROUND OF THE INVENTION

1. Field of the Invention

The present invention generally relates to a rotary drilling head utilized in combination with a rotary drilling apparatus, such as a conventional drilling apparatus employing a Kelly bar connected to a drill string with drilling fluid, either air or liquid, being used in the drilling operation with the drilling head providing a seal and wiper or stripper for the Kelly bar during its vertical and rotational movement with solid particles entrained in the drilling fluid being discharged through an outlet port in the base of the rotary drilling head with the relative rotational components being supported by thrust bearing assemblies and sealed by seal assemblies and continuously lubricated by a pressurized lubricating mist.

2. Description of Relevant Art

My prior U.S. Pat. No. 3,285,352, issued Nov. 15, 1966, discloses a rotary drilling head which includes the basic components of a base, housing or outer body and a spindle or inner body journaled and sealed in relation thereto and the structure and operation of the device disclosed in that patent is incorporated herein by reference thereto. Also, the prior art cited during prosecution of the application which matured into U.S. Pat. No. 3,285,352 also discloses rotary drilling heads which operate in a similar manner. A continuing problem with known rotary drilling heads is the wear encountered due to the abrasiveness of solid particles of the formation, or the like, entrained in the drilling fluid whether it be air, gas, liquid, or any combinations thereof. Wear caused by relative rotation between components in an abrasive environment results in the necessity of replacing components which requires that the drilling apparatus be shutdown while the drilling head is undergoing repair or replacement of parts.

SUMMARY OF THE INVENTION

An object of the present invention is to provide a rotary drilling head having a pressurized lubrication system combined with a unique seal arrangement between a stationary housing and a rotary internal spindle to not only provide continuous and adequate lubrication for the supporting bearing assemblies but also to preclude the entry of abrasive particles into the interface between the spindle and housing in order to assure longevity of these components.

Another object of the invention is to provide a rotary drilling head incorporating a split clamp structure securing the housing into the tubular base to facilitate easy removal thereof for replacement or interchange of components.

A further object of the invention is to provide a rotary drilling head having easily replaceable and interchangeable components to enable easy repair and replacement of components and to enable the drilling head to be utilized with various types of stripper rubbers depending upon the drilling apparatus with which the drilling head will be used and installational requirements for each drilling operation.

Still another object of the invention is to provide a rotary drilling head which is effective in operation, easily repaired and maintained, long wearing and capable of assembly and disassembly in a short time.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
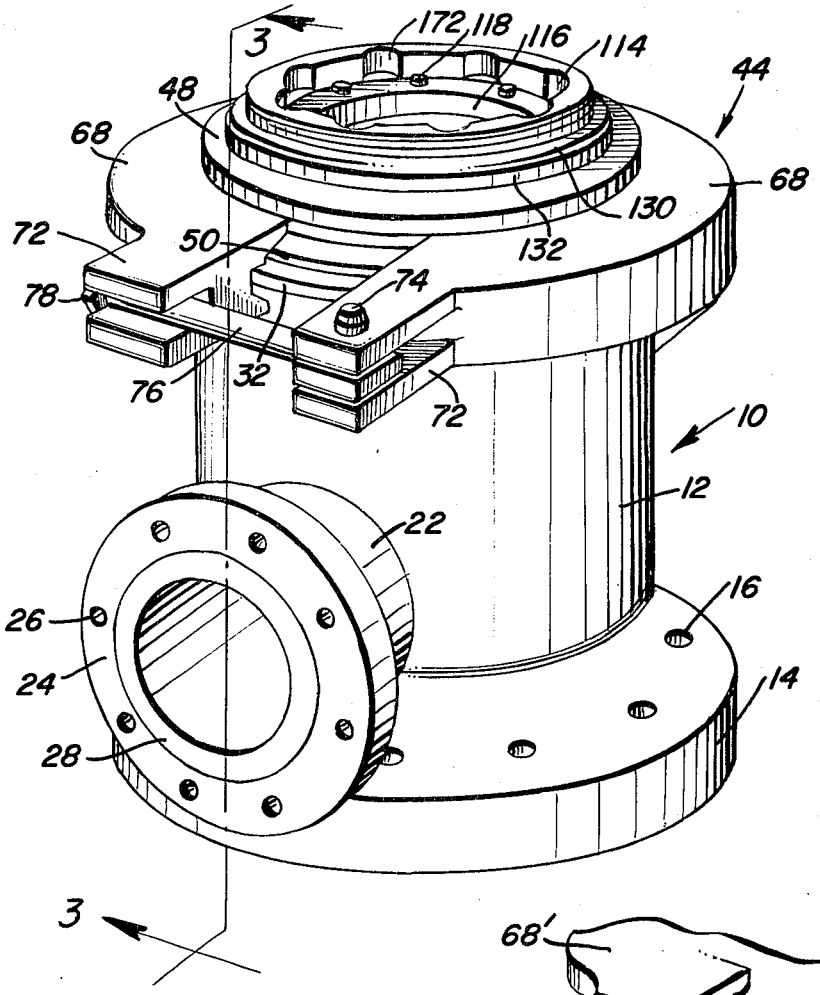
FIG. 1 is a perspective view of the rotary drilling head of the present invention.

Referring now specifically to the drawings, the rotary drilling head of the present invention is generally designated by the numeral 10 and includes a tubular base 12 which is adapted to be connected to and form the upper end of a well casing (not shown). The tubular base 12 includes a peripheral flange 14 at its lower end provided with a plurality of holes 16 for receiving anchoring bolts to secure the drilling head to the well casing in a well-known manner with the lower surface of the flange 14 including a peripheral groove 18 for receiving an O-ring seal to seal the base 12 to the casing.

The interior of the base 12 defines a vertical passageway 20 which may taper slightly outwardly and upwardly and the intermediate portion of the base is provided with a lateral discharge port or outlet 22 integral therewith and which terminates in a peripheral flange 24 having bolt holes 26 for connection to a discharge pipe. A replaceable wear sleeve 28 is received in a corresponding recess 30 in the outlet 22 which can be replaced after wear has occurred due to contact with particulate material entrained in the drilling fluid being returned upwardly through the passageway 20 and laterally outwardly through the outlet 22.

The upper end of the base 12 includes a peripheral flange 32 which has a beveled inner corner 34 which defines a seat at the upper end of the base 12 with the beveled corner 34 merging with the passageway 20 which enlarges slightly from the bottom to the top with the upper end portion of the passageway 20 where it communicates with the seat 34 being slightly enlarged as at 36 to form a slight shoulder 38, all of which cooperate to guide structure to be described hereinafter into the base 12 during assembly. The outer and lower corner of the flange 32 is also inclined at 40 for a purpose described hereinafter and disposed below the flange 32 in diametrically opposed relation to the outlet 22, a clamp supporting shelf 42 is formed on the tubular base 12 as illustrated in FIGS. 2 and 3 for supporting a split clamp structure generally designated by numeral 44 which operates in a manner described hereinafter.

Disposed internally of the base 12 and inserted from the upper end thereof, is a hollow housing or outer body 46 which is insertable into and removable from the base 12 and is removably secured thereto by the split clamp 44. The housing 46 is of one-piece construction and includes an upper flange 48 at the upper end thereof which has a beveled lower surface 50 that is spaced from and disposed in opposed relation to a lower flange 52 which is adjacent to the upper flange 48 as illustrated in FIG. 3 with the lower flange 52 including a beveled upper surface 54. Immediately below the lower flange 52, the periphery of the housing 46 is provided with a groove or recess 56 which has an inwardly angled inner surface generally paralleling the seat 34 and which receives an annular seal 58 which is generally of constant thickness from top to bottom but with a central inclined portion that parallels the inclined surfaces of the groove 56 and the seat 34 with this inclined portion sealingly engaging the seat 34 when the housing 46 is assembled into the base 12. The lower edge of the seal 58 is provided with a lip 60 on the exterior thereof for sealing engagement with the surface 36 of the passageway 20 above the shoulder 38. The upper edge of the seal 58 abuts against the bottom of the flange 52 and the lower edge of the seal 58 engages the lower edge of the groove 56 as illustrated in FIG. 3. Spaced below the groove 56, the exterior of the hollow housing 46 includes a peripheral groove 62 which receives a lower seal ring 64 which is also of the type that has a lower peripheral lip 66 at the lower outside edge thereof for engaging the interior surface of the passageway 20 thereby sealing the housing 46 to the interior of the base 12.

Figure 4:
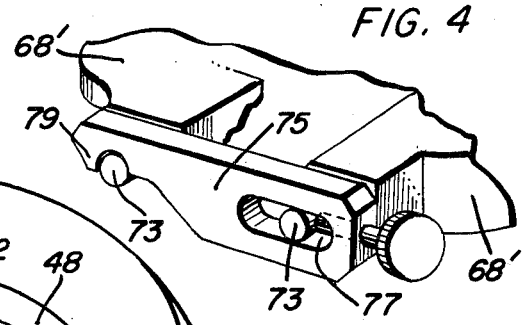
FIG. 4 is a fragmental perspective view of a portion of the split clamp illustrating a quick acting structure.
Figure 2:
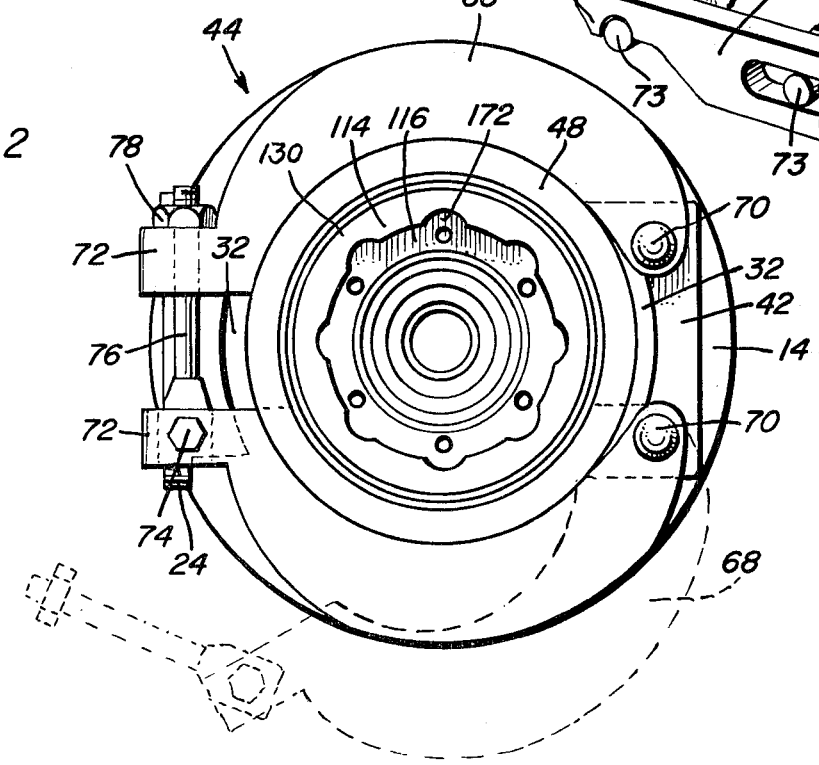
FIG. 2 is a top plan view of the rotary drilling head.
Figures 3, 5:
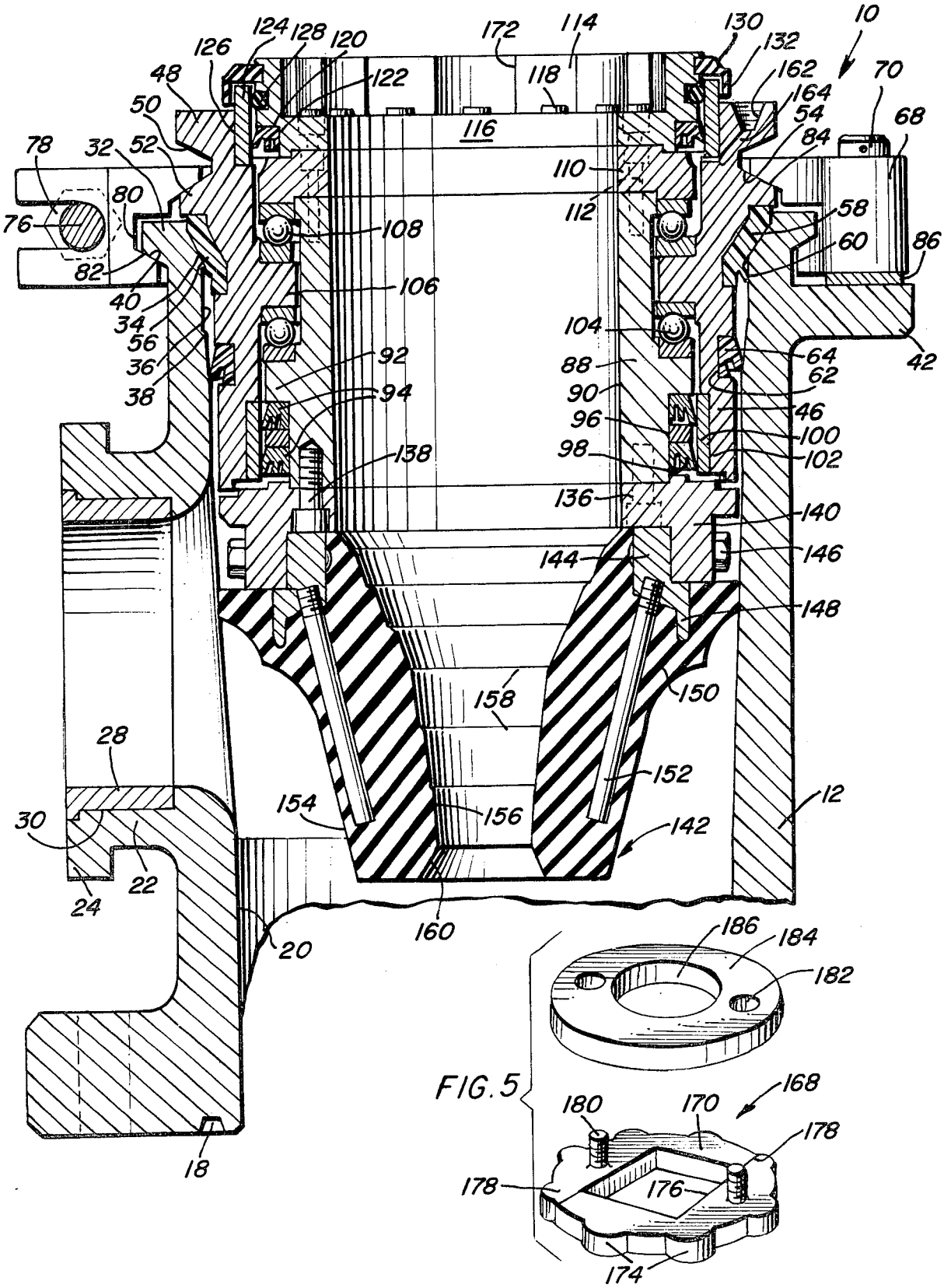
FIG. 3 is a longitudinal, vertical sectional view taken substantially upon a plane passing along section line 3—3 of FIG. 1 illustrating the specific structural arrangement and association of the components of the rotary drilling head.
FIG. 5 is an exploded perspective view illustrating a drive adapter for transmitting driving torque to the spindle of the rotary head.

The split clamp 44 includes a pair of clamp members 68 each of which are slightly less than semi-circular in configuration with one end of each clamping member being pivotally mounted on a mounting pin 70 rigidly connected to and extending upwardly from the clamp shelf 42 so that the clamp members can pivot about the vertical axes of the laterally spaced and aligned mounting pins 70 as illustrated in FIG. 2. The other end of each of the clamping members 68 is provided with a pair of outwardly extending lugs 72 with one pair of lugs including a mounting bolt or pin 74 extending therethrough for pivotally supporting one end of a clamp bolt 76 therebetween with the other end of the clamping bolt 76 extending between the lugs 72 on the other clamping member and a retaining nut 78 is threaded onto the bolt 76 so that by tightening the nut 78, the clamp members may be drawn into tight clamping engagement with the upper flange 32 on the base 12 and the lower flange 52 on the housing 46. As illustrated in FIG. 3, the interior of each clamp member 68 is provided with a peripheral groove 80 in the interior thereof with the groove being of a larger diameter at its lower edge portion as compared to its upper edge portion and the bottom surface of the groove 80 is inclined at 82 to engage the inclined surface on the lower edge of the flange 32 and the top surface of the groove 80 is oppositely inclined at 84 to engage the bevel surface 54 so that when the clamp members 68 are tightly clamped onto the base 12 and housing 46, the housing 46 will be cammed downwardly thereby securely seating the housing 46 by partially compressing the upper seal 58 between the seat 34 and the inclined inner wall of the groove or recess 56. This arrangement provides a quick clamping action and enables quick and easy assembly and disassembly of the housing with respect to the base. While a clamp bolt has been illustrated, other clamping devices may be used such as cam devices, over center devices, and the like, capable of tightening the clamp members 68 together or loosening them. FIG. 4 illustrates a modified structure in which the clamp members 68' have outwardly extending pins 73 rather than ear 72 as in FIGS. 1–3. A clamp 75 having a slot 77 therein receives one pin 73 and a recess or hook 79 on the other end to releasably engage the other pin. A screw threaded member 81 engages the pin 73 in slot 77 and enables the clamp bar 75 to be tightened or loosened so it can be pivoted upwardly to quickly and effectively tighten and release the clamp. In order to retain the clamp members 68 on the mounting pins 70, a support washer 86 may be provided between the clamp shelf 42 and the pivotal clamp member with the washer being constructed of metal, plastic, fiber, or the like, which serves as a spacer to properly position the clamp members. Also, any suitable type of retainer may be provided, such as a transverse pin through the upper end of the mounting pins to removably retain the clamp members on the mounting pins.

Rotatably supported within the interior of the stationary housing 46 is an inner body or spindle 88 having an interior passageway 90 which may be square, circular, or any other configuration adapted to receive a polygonal Kelly bar, or the like. The spindle 88 includes an external peripheral flange 92 disposed above the lower end thereof which forms a seat for a pair of vertically spaced seals 94 having a spacer 96 therebetween with each of the seals 94 including a pair of concentric grooves in the lower edge thereof defining a flexible lip 98 on the lower outer corner thereof. The seals 94 and specifically the lips 98 engage the inner surface of a wear sleeve 100 disposed in a recess 102 in the lower inner surface of the housing 46 as illustrated in FIG. 3.

Disposed above the flange 92 and seated thereon is a lower thrust ball bearing assembly 104 which has its lower race engaged against the flange 92 and its upper race engaging the lower surface of an internal flange 106 on the central interior portion of the housing 46. Disposed above the flange 106 is an upper thrust ball bearing assembly 108 which has its lower race engaged with the top surface of the flange 106 and its upper race engaged by an annular bearing retainer or ring 110 which is disposed against and bolted to the upper end of the spindle 88 by countersunk cap screws, bolts, or the like, 112, which enables assembly of the spindle 88, seals and bearing assemblies with the respect to the housing 46.

Mounted on top of the bearing retainer 110 is a top member or cap 114 in the form of an annular member and which includes an inner flange 116 overlying the upper edge portion of the bearing retainer 110 and being secured thereto by countersunk cap screws or bolts 118. The lower external periphery of the cap 114 is provided with a recess 120 which receives a lipped seal 122, similar to the seals 94, which engages with a wear sleeve 124 received in a recess 126 in the housing 46 at the upper end thereof with the sleeve 124 extending slightly above the upper end of the housing 46. Spaced above the recess 120, an O-ring seal 128 is provided in an appropriate groove in the exterior of the cap 114. Adjacent the upper edge of the cap 114, the periphery thereof is provided with a flexible mud slinger type seal 130, the inner edge of which is also received in a groove. The mud slinger seal 130 is generally right angular in configuration with a depending peripheral edge portion 132 thereof extending downwardly around the external periphery of the upper edge of the wear sleeve 124 as illustrated in FIG. 3.

Attached to the lower end of the spindle 88 is an annular adapter plate 136 secured to the lower end of the spindle by countersunk cap screws, bolts, or the like 138 and including a depending flange 140 spaced outwardly from the inner peripheral edge of the adapter plate 136. The adapter plate 136 provides a structure for attaching an interchangeable wiper or stripper rubber 142 which includes a mounting ring 144 at its upper end which telescopes into the flange 140 with mounting bolts 146 extending through the flange 140 and the ring 144, as illustrated in FIG. 3, to enable interchange of the stripper rubber 142 to adapt it to different types and sizes of Kelly bars. The mounting ring 144 includes a depending flange 148 which is encapsulated in the resilient body 150 of the stripper rubber 142. A plurality of downwardly and inwardly converging reinforcing pins or rods 152 are threaded into the mounting ring 144 and encapsulated in the body 150 to reinforce the resilient body 150 with the rods 152 being constructed of fiberglass, or the like. The external surface of the resilient body 150 tapers downwardly and inwardly as indicated by numeral 154. The downwardly tapering external surface 154 provides a passageway from the interior of the base 12 to the outlet 22 and also serves to deflect material laterally toward the outlet port. The interior surface of the body 150 also converges downwardly and inwardly as indicated by numeral 156 and includes a plurality of vertically spaced shoulders 158 which define junctional areas between adjacent downwardly inclined portions of the interior surface 156 with the lower end of the passageway through the body 150 diverging outwardly as indicated by numeral 160 and the upper edge thereof merging with the interior bore or passageway 90 of the spindle 88.

To provide pressurized lubrication to the bearings and seals, the upper surface of the upper flange 48 is provided with an internally threaded fitting 162 to which is connected a pressure line from a source of lubricating oil and air which are mixed in a manner to provide a lubricating mist supplied to the fitting 162 in any suitable manner. The threaded fitting 162 has an angulated passageway 164 communicating with the lower end thereof at one end with the other end of the passageway communicating with the space between the interior of the housing 46 and the exterior of the spindle 88 and bearing retainer 110 immediately below the seal 58 on the cap 114. This passageway continues downwardly between the bearing retainer 110 and the inner surface of the housing 46 and past the upper race of the upper bearing assembly 108 to provide passage for the lubricating mist. The lubricating mist then passes downwardly between the exterior surface of the spindle 88 and the inner surface of the lower race of the upper bearing assembly 108 and downwardly between the outer surface of the spindle 88 and the flange 106 on the housing 46 and past the interior edge of the upper race of the lower bearing assembly 104. The lubricating mist then passes through the bearing assembly 104 down past the exterior of the lower race of the lower bearing assembly and into the area between the lower seals 94 and spacer 96 and the wear sleeve 100 and then is discharged outwardly between the lower end of the housing 46 and the upper surface of the adapter plate 136. As illustrated, where components of the spindle are interconnected, such as between the lower end of the spindle and the adapter plate and between the upper end of the spindle and the bearing retainer and between the bearing retainer and the cap, offset flanges are provided to assure proper alignment and positioning of these components. Also, bearing seats are provided for the upper and lower races of the ball thrust bearings in a manner to provide passageway for the lubricating oil and air mist thereby assuring proper lubrication of the surfaces between relatively rotating components and proper lubrication for the bearing assemblies.

In this construction, the spindle mounted adapter plates are varied to accept and mount various manufactured types of stripper rubbers to seal the Kelly bar and divert the rising fluid, such as air, and cuttings out through the outlet in the base and away from the platform area. Available stripper rubbers are of different compounds for special applications and of different physical dimensions to accept various sizes of tubing, drill strings, Kelly bars, and the like. The stripper rubber of this invention being molded with fiberglass rods therein prevent the rubber from turning inside out from friction of the casing, drill string or Kelly when being passed upwardly through the stripper. In this construction, the Kelly drive bushing is cast of a urethane based compound which is light, tough and sufficiently flexible to absorb shock from misalignment, bent drill string or rough drilling thereby cushioning vibration and shock loads so that they are not so severely transmitted to the bearing areqs and housing. FIG. 5 illustrates the structural details of the drive bushing or adapter 168 which includes a two-piece body 170 of cast urethane which fits loosely into member 114 with member 114 including a plurality of semi-cylindrical notches 172 receiving similar projections 174 on the periphery of the body 170. The center of body 170 includes a square, hexagonal or other shaped hole 176 to fit the specific shape of the Kelly bar and transmit driving force to the spindle 88. The body 170 has a pair of lines of separation 178 extending outwardly from the hole 176 to enable the two pieces of the body to be separated and placed around the Kelly bar. Also, the body 170 has a pair of upwardly extending bolts 180 cast therein when formed which are received in a pair of holes 182 in a connecting ring or band 184 which has a circular hole 186 larger than the Kelly bar. The ring or clamp band 184 serves the purpose of interconnecting the two pieces of the adapter 168 when nuts are placed on bolts 182 with the hole 186 received over the end of the Kelly bar and remaining thereon when the body 170 is assembled or replaced with it being pointed out that the hole 186 is sufficiently large that it does not contact the Kelly bar and does not transmit any driving force. This type of flexible drive bushing also reduces wear on the Kelly bar by eliminating metal-to-metal contact as occurs in previous drive bushings. An additional safety factor is provided by this type of non-metallic drive bushing over a metallic one by insulating the Kelly bar from any metal contact with the rotating unit thereby reducing the possibility of creating a dangerous spark. The deep groove ball thrust bearing assemblies utilized provide better distribution of vertical and lateral thrust forces and the bearing race grooves are extremely surface hardened through known induction heating techniques and the hardness is gradually reduced through the race thicknesses to avoid the normally brittle nature of a bearing in which the races are hardened throughout the thickness which provides for a reduction in the possibility of bearing failure from cracking of the races. The top body seal is molded from a urethane base compound and it is flexible and forms to outside pressures and the inclined structure thereof enables it to be compressed tightly between the beveled or inclined surface on the base and the beveled or inclined surface on the housing and the lower edge of the top seal is of a lip-type to seal the outside body when air pressure from below is applied.

Internally of the spindle, the seals are of a similar nature and are molded to seal inward and outward from air pressure against the exposed areas. The top seal is positioned as to seal tight when internal air or oil mist pressure is applied which retains the air-oil mist from escaping through the top area thus requiring the pressure to enter the cavity between the housing and spindle. The lower seals are positioned so that internal air-oil mist pressure reaching them from the reverse side of the lip will enable the two seals to be unseated when pressure builds up so that they are slightly separated from the wear sleeve thereby permitting excess air to escape. Pressure is required to open these two lower seals so a relative amount of internal air pressure is always present thereby helping to keep outside contamination from entering the assembly. The spindle sleeves are designed with an extra recess in the lower edge to create a lip on the outside edge of the seals so pressure from the bottom area will create a more positive seal with the body.

Lubrication is supplied by metering of lubricating oil or fluid into a high pressure air line connected to the top of the housing with this mixture being channeled through the top bearing down the passage between the housing and spindle and through the lower bearing and to the lower seals where the air-oil mist pressure forces the seals to open and escape through the lower spindle opening. This continuous flow maintains a clean interior and deposits a film of oil on all of the internal parts. If the internal pressure is reduced for any reason to a pressure less than the pressure built up in the well, the reverse pressure will press the lower lip seals into tight sealing engagement thereby sealing the lower area so that no contamination can enter at this point. The flow-through lubricating mixture also supplies internal cooling to the seals and bearings thus further increasing the life expectancy of these components.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A rotary drilling head comprising a tubular base adapted to be connected to a well casing, or the like, and including a lateral discharge outlet, said base including a generally vertical passage open at the upper end, a housing inserted into the upper end of said base in sealed relation thereto, means removably securing said housing in said base, a spindle mounted in said housing, bearing means rotatably supporting the spindle in said housing, sealing means interposed between the spindle and housing, means associated with the spindle and housing to supply a continuous pressure lubricating material to the interface between the spindle and housing and to the bearing means and sealing means therebetween, and means connected with the upper end portion of the spindle and adapted to be drivingly engaged by a Kelly bar extending therethrough for rotatably driving said spindle, said housing being generally cylindrical in configuration and provided with a generally centrally located inwardly extending annular flange, said bearing means including a pair of ball-type thrust bearing assemblies engaged with the upper and lower surfaces of the flange on the housing respectively, said spindle including a generally cylindrical exterior with an outwardly extending flange adjacent the lower end thereof engaged with the lower thrust bearing assembly, and a bearing retaining ring releasably mounted on the spindle engaging the upper thrust bearing assembly thereby enabling assembly of the housing, spindle and bearing assemblies.

2. The structure as defined in claim 1 wherein said means supplying lubricating material includes means at the upper end of the housing for connection with a source of air-oil mist, said housing including a passageway extending inwardly from the means connected to the source of lubrication to the interface between the housing and spindle, said bearing retainer and flanges on the housing and spindle being dimensioned to provide an annular space extending downwardly between the housing and spindle, inwardly through the upper bearing assembly, downwardly between the flange on the housing and spindle, outwardly through the lower bearing assembly, and downwardly between the flange on the spindle and the housing for discharge from the bottom of the spindle and housing, said sealing means between the spindle and housing including at least one lipped seal engaging the lower surface of the flange on the spindle to enable discharge of pressurized lubricant downwardly and preventing upward movement of pressurized material from the interior of the base and well casing thereby protecting the interface and bearing assemblies from contamination by particulate material.

3. The structure as defined in claim 1 together with an adaptor plate releasably mounted on the lower end of the spindle for rotation therewith, a stripper rubber mounted on the adaptor plate for engagement with a Kelly bar, or the like, extending through the spindle, said stripper rubber including a body of resilient material having a mounting ring at the upper end thereof, said adaptor plate including a depending flange telescopically receiving the mounting ring, and fasteners extending through the depending flange and mounting ring to enable removal of and interchange of stripper rubbers to adopt the rotary head to receive different sizes and types of Kelly bars, and the like.

4. The structure as defined in claim 3 wherein said stripper rubber body includes a plurality of downwardly converging reinforcing rods rigidly affixed to the mounting ring and encapsulated in the body for reinforcing the body.

5. The structure as defined in claim 1 together with a cap releasably mounted on the bearing retainer ring and including a plurality of vertically spaced seals sealingly engaged with the housing to prevent upward flow of lubrication with the uppermost seal on the cap including a downwardly extending peripheral portion overlying a portion of the upper end of the housing to provide a mud slinger seal at the upper end of the spindle to preclude entry of particulate material between the upper end of the housing and the upper end of the spindle.

6. The structure as defined in claim 5 wherein the inner surface of the housing in opposed relation to the seals at the lower end of the housing and at the upper end of the housing includes removable wear sleeves engaged by the seals.

7. The structure as defined in claim 1 wherein said means securing the housing to the base includes an outwardly extending peripheral flange at the upper end of the housing, an outwardly extending peripheral flange at the upper end of the base, said housing and base including downwardly and inwardly inclined opposed seats immediately below the respective flanges, and a seal member interposed between the inclined seats to form a seal between the base and housing adjacent the upper end thereof.

8. The structure as defined in claim 7 together with an additional seal means between the housing and base disposed below the seal between the inclined seats.

9. The structure as defined in claim 7 wherein the flange on the base includes an inclined outer lower surface and the flange on the housing includes an inclined outer upper surface, a split clamp having oppositely facing, inwardly disposed inclined surfaces engaging the inclined surfaces on the flanges on the base and housing to cam the housing downwardly into tight sealing engagement with the base when the split clamp is tightened.

10. The structure as defined in claim 9 wherein said split clamp includes a pair of clamp members, said base including a supporting shelf adjacent the flange at the upper end thereof, upwardly projecting supporting pins on the shelf for pivotally supporting the clamp members, and manually actuated means interconnecting the clamp members remote from the pins for clamping and unclamping the clamp members in relation to the flange on the base and the flange on the housing.

11. The structure as defined in claim 10 wherein said manually actuated means includes a hook member pivotally and slidably mounted on one clamp member and hookingly engaged with the other clamp member when pivoted to operative position, and screw threaded means on the hook member to slide it in relation to the clamp member on which the hook member is mounted to tighten and loosen the clamp members in relation to the flanges.

12. The structure as defined in claim 1 wherein said outlet port is provided with a removable wear sleeve therein, said port being disposed generally in alignment with the lower end of the spindle, and means mounted on the lower end of the spindle for sealingly and strippingly engaging a Kelly bar, or the like, and deflecting returning drilling fluid and any particulate matter entrained therein outwardly through the outlet.

13. The structure as defined in claim 1 wherein said drive means for the spindle includes a body of non-metallic material of two-piece construction, said body having a central opening of polygonal configuration receiving and drivingly connected to the Kelly bar, and coacting lugs and notches on the body and spindle to transmit driving force between the body and spindle.

14. The structure as defined in claim 13 wherein said body is constructed of urethane, and a one-piece connector ring overlying and connected to each piece of the body to retain the body assembled and to permit disassembly thereof.

* * * * *